US005669459A

United States Patent [19]

Larsen et al.

[11] Patent Number: 5,669,459

[45] Date of Patent: Sep. 23, 1997

[54] NOZZLE RETENTION SYSTEM FOR ROCK BITS

[75] Inventors: James L. Larsen, Spring; Michael A. Siracki, The Woodlands, both of Tex.

[73] Assignee: Smith International, Inc., Houston, Tex.

[21] Appl. No.: 547,123

[22] Filed: Oct. 23, 1995

[51] Int. Cl.[6] ..... E21B 9/08

[52] U.S. Cl. ..... 175/340; 175/393

[58] Field of Search ..... 175/340, 339, 175/393, 424

[56] References Cited

U.S. PATENT DOCUMENTS

| | | | |
|---|---|---|---|
| 4,126,194 | 11/1978 | Evans . | |
| 4,187,921 | 2/1980 | Garner . | |
| 4,189,014 | 2/1980 | Allen et al. . | |
| 4,516,642 | 5/1985 | Childers et al. . | |
| 4,546,837 | 10/1985 | Childers et al. . | |
| 4,611,673 | 9/1986 | Childers et al. . | |
| 4,665,999 | 5/1987 | Shoemaker . | |
| 4,687,067 | 8/1987 | Smith et al. | 175/340 |
| 4,759,415 | 7/1988 | Pessier . | |
| 4,848,476 | 7/1989 | Deane et al. . | |
| 5,029,656 | 7/1991 | Ivie et al. . | |
| 5,096,005 | 3/1992 | Ivie et al. . | |
| 5,494,122 | 2/1996 | Larsen et al. | 175/340 |

*Primary Examiner*—William P. Neuder

*Attorney, Agent, or Firm*—Robert M. Vargo; Robert G. Upton

[57] ABSTRACT

A nozzle retention receptacle for rotary cone rock bits consists of a nozzle retention receptacle body forming a fluid passage therethrough. The body forms a first upstream entrance end that forms part of a wall of a plenum formed within a rock bit body and a second downstream exit end. The upstream end further forms a mounting interface that circumvents a fluid entrance port to the passage in the nozzle retention receptacle. The port communicates with the fluid plenum in the bit body. The body of the rock bit further forms a nozzle retention receptacle mounting interface that is common to the mounting interface formed by the nozzle retention receptacle.

11 Claims, 6 Drawing Sheets

FIG. 8
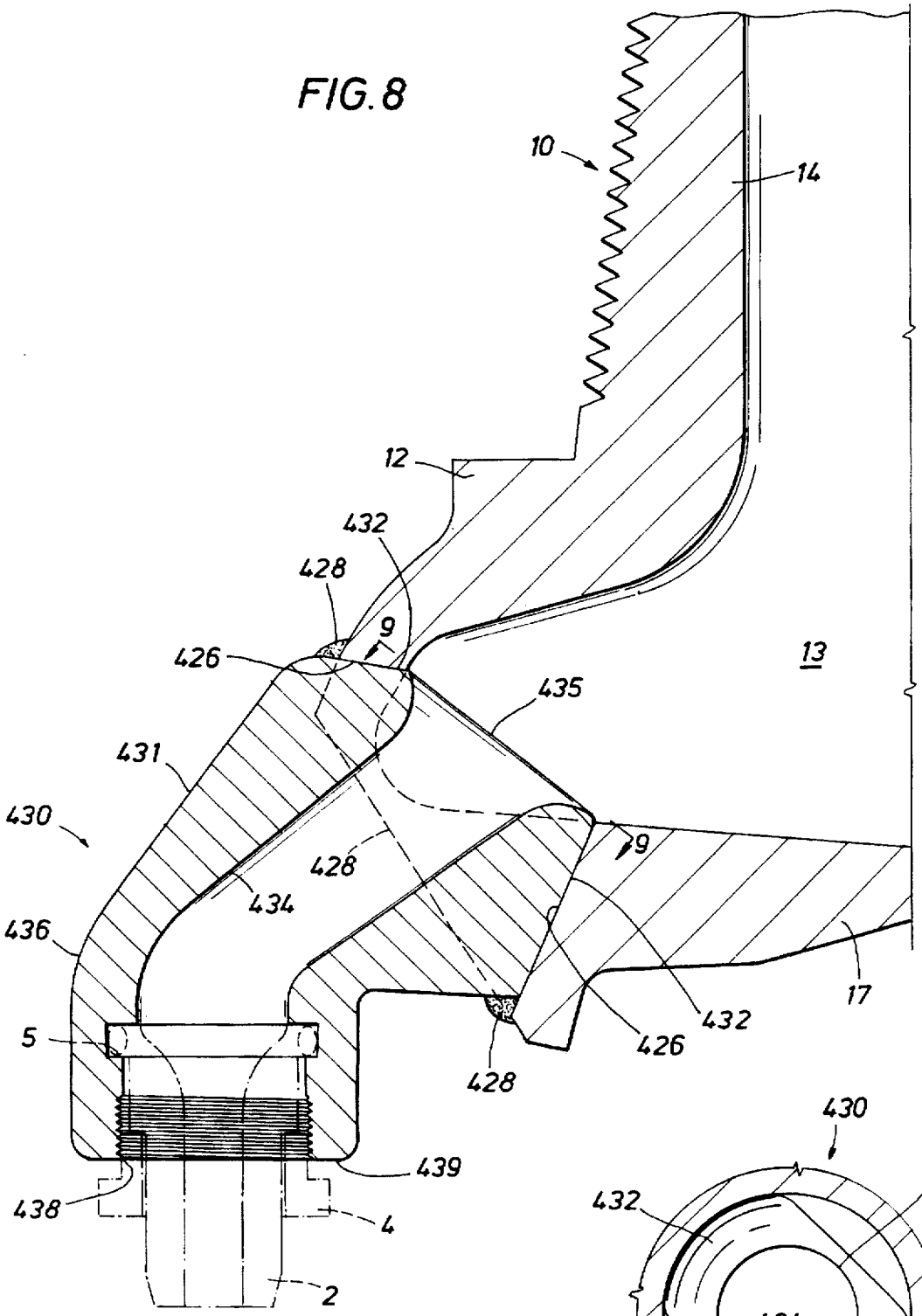
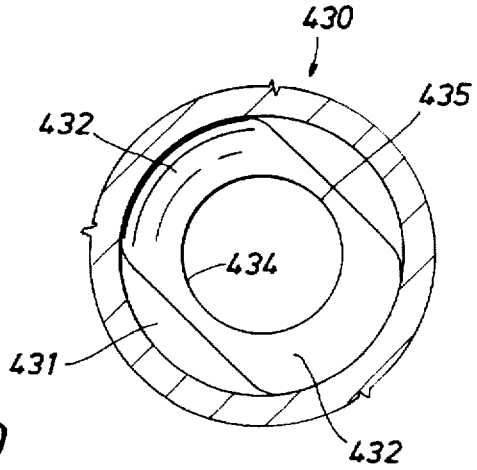
FIG. 9

NOZZLE RETENTION SYSTEM FOR ROCK BITS

CROSS-REFERENCE TO RELATED APPLICATION

This invention relates to a previously fled patent application entitled COMPOSITE NOZZLES FOR ROCK BITS fled Oct. 4, 1994.

BACKGROUND OF THE INVENTION

1. Field of the Invention

This invention relates to a means to improve fluid flow capacity, improve durability through a nozzle retention component and a method to position the flow exit closer to a borehole bottom by providing a nozzle retention component for replaceable jet nozzles for rotary cone rock bits that results in an increased rate of penetration of the bit as it works in a borehole.

More particularly, this invention relates to hydraulic components for the retention of replaceable nozzles utilized in the fluid nozzle system that provide a larger fluid entrance to the nozzle retention component. The body of the component becomes a portion of the rock bit body that closes out the hydraulic plenum formed by the bit body. A much lower fluid velocity is the result when the fluid enters the passage formed by the nozzle retention component.

The design and manufacturing system set forth in this invention provides the means to improve hydraulics for more efficient fluid management while reducing erosion problems and to provide a means to move the exit plane of the nozzle jet closer to the borehole bottom for improved rate of penetration (ROP) while providing a more robust nozzle retention system that is beneficial especially in the more demanding directional drilling operations.

2. Background

Conventional nozzle systems typically have the exit planes of the nozzles far off the borehole bottom resulting in poor bottom hole cuttings removal and inadequate cleaning of the rotary cutter cones. This condition exists even where one to four jet nozzles are utilized.

An example of an attempt to improve bottom hole cleaning is taught in U.S. Pat. No. 4,759,415. A nozzle extension tube is welded into a receptacle normally used for standard nozzles and does place the exit of the nozzle about 80 percent closer to the borehole bottom than the standard nozzle. The tube is directed between rotary cones toward the borehole bottom. Since there is limited space between cones, the tube is necessarily narrow adjacent the cone cutting structure hence it is prone to breakage. Moreover, utilization of an existing nozzle receptacle results in a small weld length when securing the nozzle extension body to the bit thereby increasing the risk of nozzle tube breakage. Furthermore, the bend "s" and the smaller flow passage in the tube results in a restricted flow rate and an increased risk of washouts in the system.

A mini-extended nozzle is taught in U.S. Pat. No. 4,687,067 assigned to the same assignee as the present invention and incorporated herein by reference. While the mini-extended nozzle is about 40 percent closer to the borehole bottom than a standard nozzle resulting in better cuttings removal, it is not dose enough for maximum effectiveness for cuttings removal. The length of the nozzle is necessarily limited by the cutter cones where standard nozzle receptacles are utilized.

U.S. Pat. Nos. 4,516,642; 4,546,837; 4,611,673; 4,848,476; 5,029,656 and 5,096,005 all relate to a means to direct pressurized drilling fluid across certain of the cutting elements protruding from the cutter cones of a rotary cone drill bit and thereafter, against the bottom of a drilled formation. Pressurized fluid exits the nozzle jets above the axis of the rotary cones, passes over the cutting elements and impacts the borehole bottom at or near the leading edge of the cones rolling on the formation. While the basic idea of cleaning the cutting elements of rotary cones is effective especially in sticky formations, the high pressure flow aimed at the cones results in cone erosion and to a lesser extent, loss of cutter inserts due to the erosive effects of the concentrated fluid.

A prior art nozzle receptacle has been designed in an attempt to increase flow rates over conventional nozzle receptacles. There is an elliptical hole interface between the nozzle receptacle and the plenum formed by the bit body. This results in a limitation relative to orientation of the receptacle and the elliptical opening in the bit body. A difficulty in aligning the pair of elliptical openings in the receptacle and the bit body can lead to misalignments. Any misalignment may cause increased fluid velocities, turbulent eddy currents, and separated flow, all of which are conducive to generating internal erosion problems. In addition, the 'bend' in the receptacle is actually two intersecting cylinders with relatively severe changes of directions that could lead to washouts and higher localized flow rates around the corners.

The present invention effectively eliminates these alignment problems by making the nozzle receptacle part of the bit body forming the internal fluid plenum for the rock bit. Moreover, much greater flow rates into the nozzle receptacle are possible without generating erosive eddy currents or separated flow due to the larger streamlined opening into the receptacle.

Patents relating to a cross-flow of fluid to enhance cuttings removal include the following U.S. Pat. Nos.; 4,126,194; 4,187,921; 4,189,014; 4,665,999 and 4,687,067 all of which are assigned to the same assignee as the present invention and incorporated herein by reference. The '194 patent utilizes a pair of nozzles near the hole perimeter between rotary cones that sweep cuttings across a borehole bottom toward a pickup tube positioned between rotary cones opposite the pair of nozzles. The '921 patent utilizes one or more cavitating nozzles opposite a conventional nozzle. The pressure differential between the cavitating nozzle and the conventional nozzle causes the fluid exiting the conventional nozzle to move toward the low pressure side of the bit thereby moving the cuttings across the borehole bottom. The '014 and the '067 patents both eliminate one of the nozzles in a 120 degree rock bit segment so that fluid moves from the nozzles in the other two 120 degree bit segments toward the "blank" segment entraining cuttings en route across the borehole bottom. The '999 patent utilizes nozzles of a differing length at each 120 degree bit segment to enhance a cross-flow of drilling fluid through the pressure differential developed between each of the unique nozzles.

While each of the foregoing patents is effective in moving cutting from the bottom of a drilled hole, there is considerable need for improvement in managing drilling fluid through a rotary cone rock bit.

The present invention moves a high volume of drilling fluid from a rock bit plenum into an internally streamlined nozzle receptacle at a reduced flow rate and with minimized turbulence. The receptacle design further enables the nozzle jet to be located nearer the borehole bottom for enhanced cuttings removal and better cone cleaning.

In addition, the large receptacle mounting surfaces closing out the rock bit plenum provides a robust base for the nozzle jets mounted therein.

Rock bit hydraulics are constantly being optimized to increase drilling rates. This optimization process would include a means to increase fluid flow rates without generating erosive eddy currents or separated flow. Positioning of the nozzle closer to the borehole bottom is an effective means to improve bottom hole cleaning and directing at least a portion of the fluid toward the cutter cones to clean the cones is another means to optimize hydraulic performance. By positioning the nozzles closer to the borehole bottom, the possibility of damaging the cones through fluid erosion is lessened since the accelerated flow of fluid is exiting the nozzles below the cones. A controlled amount of fluid circulating around the cones without direct contact of the fluid onto the cone surface is beneficial in cleaning the cones for better ROP. Arranging the nozzles to induce cross-flow to enhance cuttings removal is yet another method to improve bit performance.

SUMMARY OF THE INVENTION

A primary object of this invention is to optimize the rock bit hydraulics while minimizing the risk of hydraulic component failure. Due to the extremely high costs associated with a premature bit failure, hydraulic components with questionable reliability are unacceptable.

It is another object of this invention to provide a nozzle receptacle with improved durability while increasing fluid flow capacity.

It is yet another object of this invention is to move the nozzle exit plane closer to the borehole bottom.

It is still another object of this invention is to provide a nozzle attachment interface with increased weld length in a rock bit body, the interface being further adaptable with a variety of nozzle receptacle forgings.

It is another object of this invention to protect the nozzle interfitted within the attachment body from damage through contact with a borehole wall or from backreaming while pulling the bit from the borehole by affixing inserts in the outside wall and the top ramped surface formed by the nozzle receptacle. The inserts may be strategically placed on the attachment body adjacent the wall of the borehole formation and on a radially inwardly ramped surface of the body nearest the attachment interface of the rock bit body to protect the attachment body from damage during back reaming or tripping operations.

More particularly, it is an object of this invention to provide a nozzle attachment body with a large interface that interfits with an interface surface formed in each 120 degree leg segment of a rotary cone rock bit body. The nozzle attachment body forming a segment of the bit body internal plenum when the nozzle attachment body in each leg segment is metalurgically bonded to the bit body.

A nozzle retention attachment body or component for rotary cone rock bits consists of a nozzle retention component body forming a fluid passage therethrough. The body forms a first upstream entrance end and a second downstream exit end, the upstream end forms a mounting interface that circumvents a streamlined fluid entrance port to a fluid passage formed by the nozzle retention component. The streamlined port communicates with a fluid plenum formed by a body of the rock bit. The body of the rock bit further forms a nozzle retention component mounting interface that is common to the mounting interface formed by the nozzle retention component. The component mounting interface formed by the rock bit body may be common to more than one nozzle retention component so that a standard sized rotary cone rock bit may be fitted with one or more of the nozzle retention components to suit a particular rock bit drilling requirement. The nozzle retention component may be secured to the rotary cone rock bit after the rotary cone rock bit has gone through the manufacturing process.

This invention details a nozzle retention design that forms part of the plenum chamber thereby providing a large and streamlined entrance for a restriction free flow of fluid to the interior of the nozzle retention component from the plenum.

Moreover, the lengthy interface formed around the nozzle retention component provides a robust attachment to a matching interface formed by the bit body.

A secondary advantage of the present design allows for the installation of multiple type nozzles into a singular rotary cone rock bit type while maintaining bit reliability and nozzle integrity. This is accomplished by designing a rock bit body and a set of nozzle receptacle attachments that are utilized for the express purpose to offer multiple hydraulic enhancements through different nozzle receptacle bodies. The rock bit body and receptacle bodies may have matching component mounting interfaces thereby enabling the customer to order a rotary cone rock bit specifically designed to suit a particular drilling environment.

The component mounting interfaces between the bit body and the nozzle receptacle may alternately be configured for a spherical ball nozzle receptacle with a socket type mounting interface formed by the bit body for three dimensional nozzle vectoring or, a curved groove mounting interface could be formed on the nozzle retention receptacle and matching curved groove interface formed by the bit body for two dimensional nozzle vectoring without departing from the scope of this invention.

A slotted groove interface in the bit body matched to the nozzle retention receptacle interface would obviously provide for one dimensional vectoring as will be described in greater detail in the following specification.

The nozzle retention receptacle body extends radially outwardly and downwardly toward a borehole bottom thereby positioning the nozzle jet closer to the bottom and adjacent the wall of the drilled borehole. In order to protect the nozzle jet from damage due to contact of the nozzle with the wall, one or more semi-round inserts may be secured to the outer surface of the receptacle near the exit plane of the nozzle. The inserts may also be secured to the ramped outer surface of the receptacle upstream of the nozzle and nearest the receptacle attachment interface to protect the receptacle and nozzle when the rock bit is 'tripped' or rotated out of the borehole. The inserts may be semi-rounded tungsten carbide inserts or semi-rounded diamond enhanced tungsten carbide inserts. However, flat or other shaped inserts could be used without departing from the spirit of the invention.

An advantage then of the present invention over the prior art is the increase of fluid flow capacity without an increase in fluid velocity that is directed through a streamlined opening formed in the nozzle receptacle, the receptacle body of which forms an integral part of the rock bit plenum after the receptacle body is welded to the rock bit.

Another advantage of the present invention over the prior art is the robust nozzle receptacle interface wherein generous and lengthy welding surfaces are provided assuring the structural integrity of the attached nozzle receptacle.

Still another advantage of the present invention over the prior art is the large orifices leading from the rock bit plenum to the nozzle receptacles thereby reducing turbulence, erosive eddy currents, or fluid separation induced by sharp corners and/or a restricted tortuous paths associated with prior art nozzle systems.

Yet another advantage of the present invention over the prior art is the exit plane of a standard fluid flow nozzle retained within the nozzle receptacle is about fifteen percent closer to the borehole bottom than comparable nozzle systems of the prior art.

Moreover, with the installation of mini-extended nozzles in the present nozzle receptacle, the exit plane of the extended nozzle is now thirty percent closer to the borehole bottom than the prior art installation, a significant improvement over the prior art.

The above noted objects and advantages of the present invention will be more fully understood upon a study of the following description in conjunction with the detailed drawings.

BRIEF DESCRIPTION OF THE DRAWINGS

FIG. 8 is a cross-section of yet another alternative embodiment wherein a plenum portion of the receptacle protrudes into the plenum portion of the rock bit body, the receptacle being more adaptable to different rock bit body plenums; and FIG. 9 is a view taken through 9—9 of FIG. 8.

DESCRIPTION OF THE PREFERRED EMBODIMENTS AND BEST MODE FOR CARRYING OUT THE INVENTION

Figure 1:
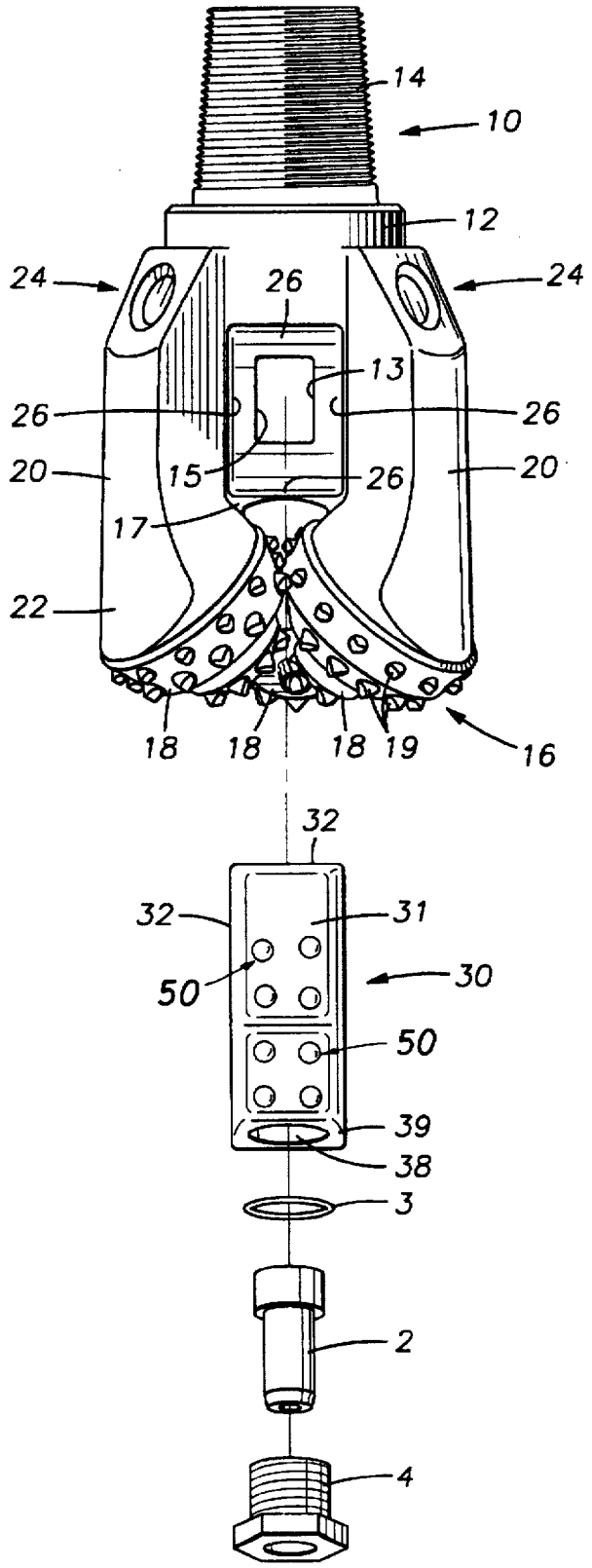
FIG. 1 is a side view of a three cone rock bit with a nozzle retention segment, nozzle and nozzle retainer exploded from the body of the rock bit.

With reference to FIG. 1, the rotary cone rock bit generally designated as 10 consists of rock bit body 12, pin end 14 and cutting end generally designated as 16. A fluid chamber or plenum 13 is formed within body 12. The plenum 13 communicates with open pin end 14 so that hydraulic fluid may enter the rock bit body through and attached drill string (not shown). A dome portion 17 defines a portion of the plenum 13 within body 12. Rock bit legs 20 extend from bit body 12 toward the cutting end of the bit 10. A cutter cone 18 is rotatably fixed to leg 20 through a journal beating extending into the cone form shirtail 22 of the leg (not shown).

Each cone 18, for example, has a multiplicity of cutter inserts 19 strategically spaced around each of the cones 18.

A lube reservoir system 24 supplies a lubricant to bearing surfaces defined between the interior of the cones 18 and the journal.

A mini-extended nozzle 2 is shown exploded from a nozzle retention body generally designated as 30. The body 30 is also exploded from the bit body 12.

As few as one and as many as four nozzles may be supported by a nozzle retention body 30 adjacent to the bit dome 17 of bit body 12. Typically, three nozzles are positioned about 120 degrees apart around the outer periphery of the dome 17 and one center jet nozzle is frequently positioned in the dome to prevent or minimize "balling" of the bit (not shown).

Figure 3:
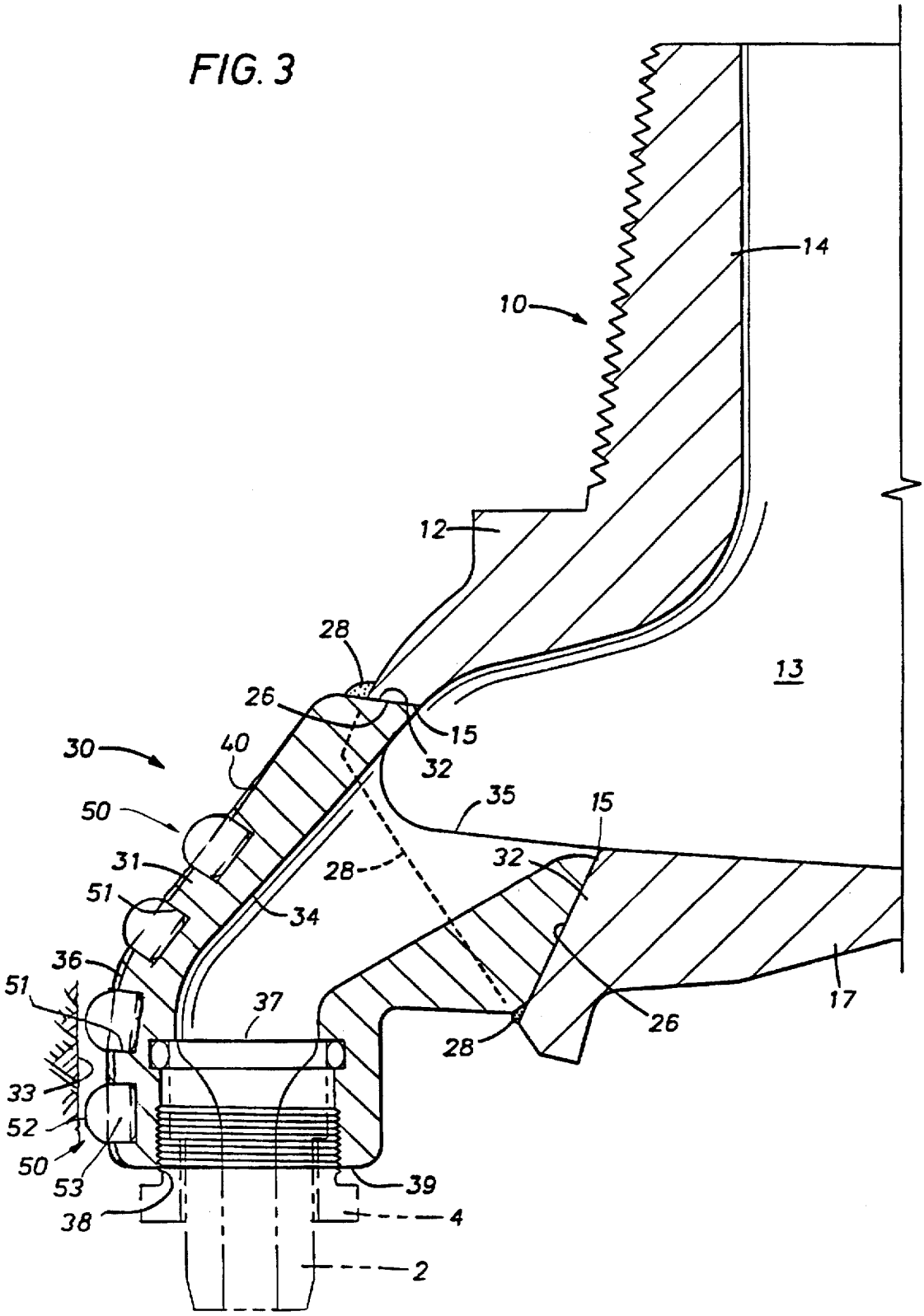
FIG. 3 is a partial cross-section of a preferred embodiment of the present invention illustrating a slide-in nozzle receptacle mated to a matching interface formed by the bit body.

Referring to the preferred embodiment illustrated in both FIGS. 1 and 3, the bit body 12 forms an interface 26 that minors interface 32 of nozzle retention body 30. The nozzle retention body casting 30 may then be of any length as long as it conforms to the interface 32 and fits within the design envelope of the bit body 12. Since the retention body 30 is relatively large, large streamlined passages 34 may be formed in the body 31 of the nozzle retainer 30. The body 31 serves to close out the plenum chamber 13 hence an enlarged streamlined opening 35 internally of the weld interface 32 is possible and desirable in the interest of more fluid capacity and less turbulence due to sharp edges typical of the prior art.

It is important to note here that there is no opening formed in the bit body to direct fluid through the formed opening to a typical nozzle of the prior art. Since the large retention body 31 forms a portion of the plenum chamber 13, no special aperture need be drilled into the chamber to adapt a flow nozzle thereto. As heretofore mentioned these prior art narrow flow passages serve to accelerate fluid flow and cause undo turbulence into the nozzle entrance. Moreover, a larger fluid opening may be formed in the bit body 12 to direct a large volume of drilling fluid into the entrance 35 of passage 34 formed by body 31 thereby minimizing erosion problems resulting from narrow fluid channels and sharp corners.

Additionally, a lengthy and generous weld 28 secures the nozzle retention receptacle 30 nestled within interface 26 of the bit body 12 resulting in an extremely strong and robust nozzle retainer that is easily adapted to a common bit size to accommodate for differing drilling requirements.

With specific reference to FIG. 3, the nozzle retention body 30 may have, for example, semi-round tungsten carbide inserts generally designated as 50 imbedded in insert holes 51 formed in wall 36 of body 31. The inserts 50 are strategically placed both adjacent the borehole formation 33 and in the ramped or conical surface 40 formed by the body 31 of the nozzle retainer 30. The inserts 50 serve to protect the nozzle 2 from contact with the formation 33 and the inserts in the ramped surface 40 protect the nozzle retainer from damage during back turning or tripping out of the formation. The inserts may be interference fitted with insert holes by pressing the insert base 53 into the retention holes 51 formed in body 31.

The semi-round end 52 of the insert 50 would assist in preventing the nozzle retainer from gouging into the wall of the formation especially during directional drilling operations by acting as a low area contact bearing surface if the rock bit should contact the formation 33.

The inserts 50 could be flush type tungsten carbide inserts or diamond enhanced cutter inserts without departing from the intent of this invention (not shown).

Moreover, the surfaces 36 and 40 of retainer 30 may be hardfaced with suitable hardfacing material such as a matrix of tungsten carbide without departing from the scope of this invention [again, not shown].

Figure 2:
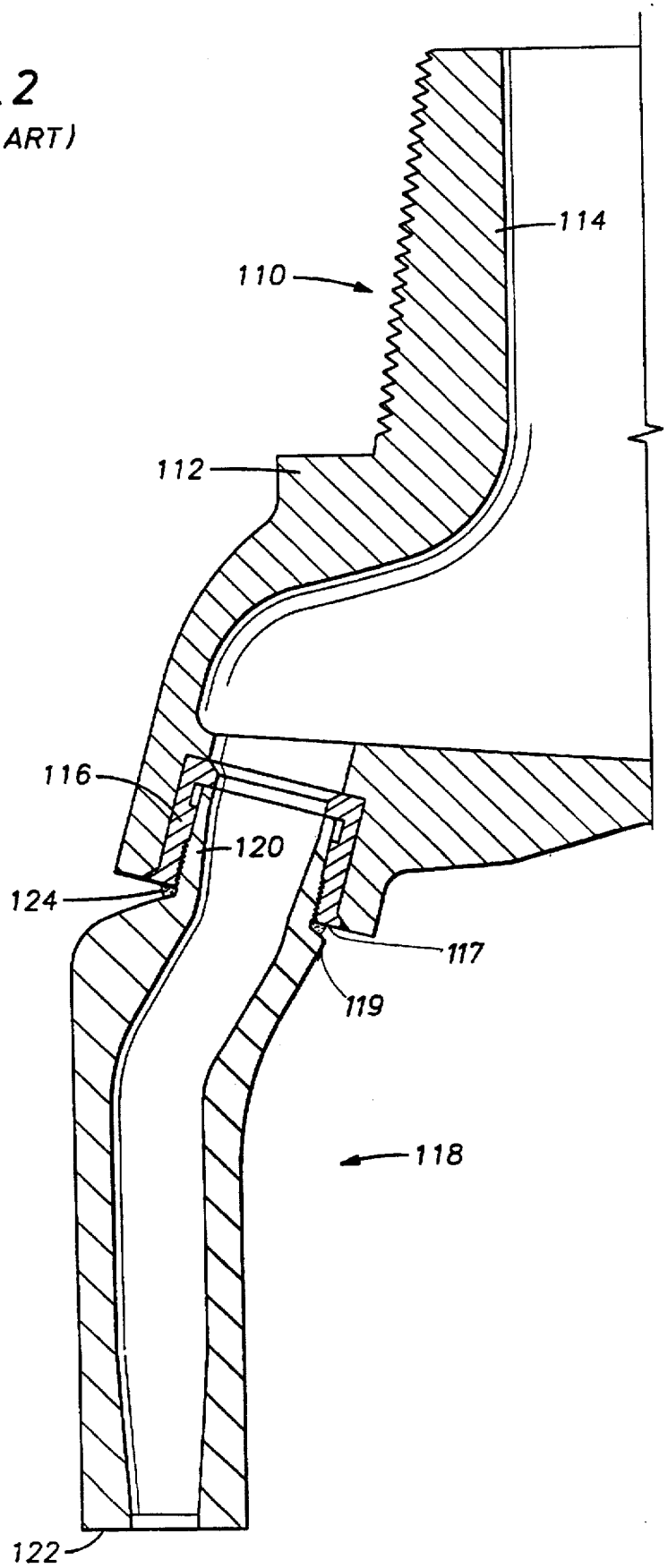
FIG. 2 (PRIOR ART)
FIG. 2 is a partial cross-section of a prior art nozzle extension segment welded within a standard jet nozzle receptacle.

The prior art of FIG. 2 illustrates one of many state of the art nozzle configurations. An extended nozzle tube generally designated as 118 is inserted into a threaded opening 117 of a standard jet nozzle receptacle 116. A base end 120 of the nozzle tube is inserted within opening 117 and welded in place at 124. Exit end 122 usually terminates just above a borehole bottom to maximize bottom hole cleaning. This type of nozzle modification is fragile due to the necessity of utilizing an existing standard nozzle receptacle opening 117 that provides little support for the extended nozzle tube welded therein.

Figure 4:
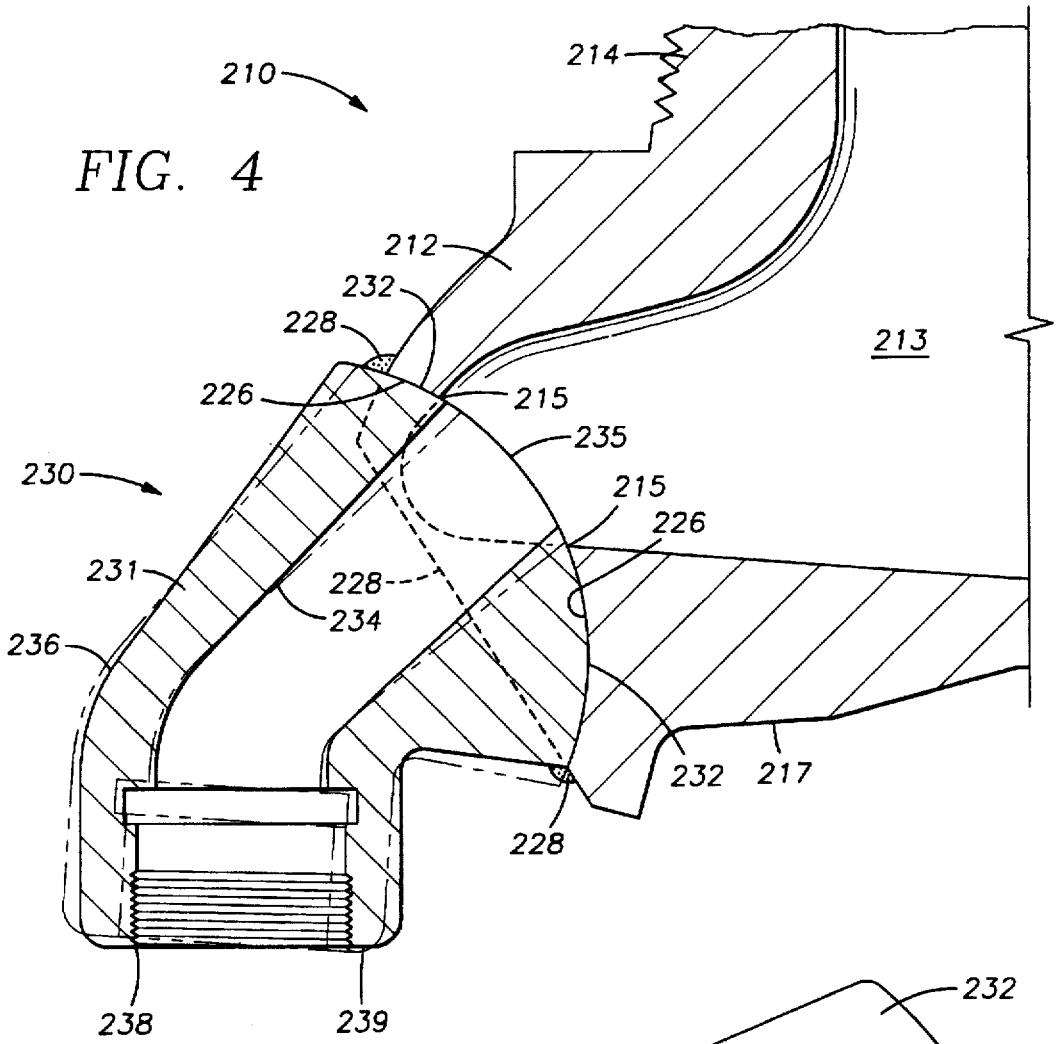
FIG. 4 is a partial cross-section of an alternative embodiment of the present invention illustrating a nozzle receptacle mated to a curved interface formed by the bit body, the curved mating surface enables the angle of the nozzle body to change with respect to an axis of the bit body thereby providing two dimensional vectoring of the nozzle.
Figure 5:
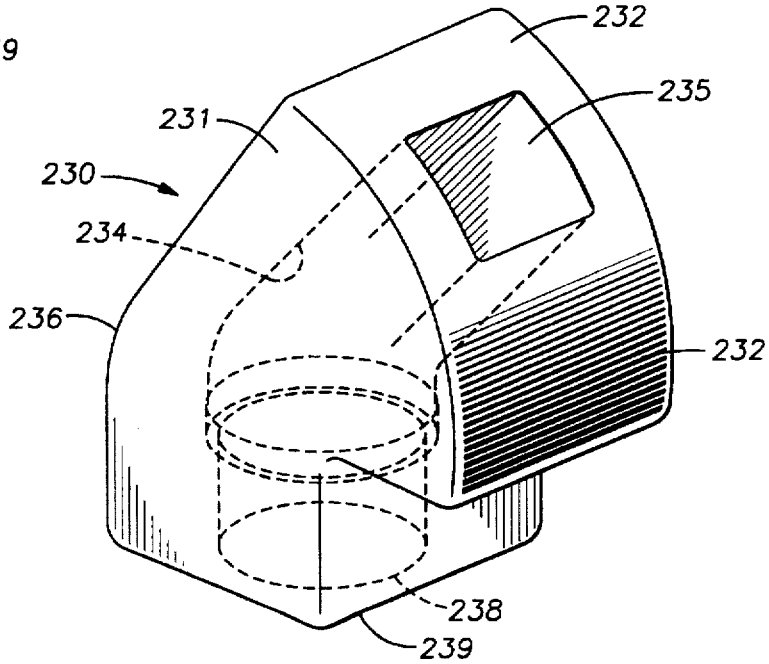
FIG. 5 is a perspective view of the nozzle receptacle of FIG. 4 clearly depicting the curved plane of the interface allowing the receptacle to slide on the curved interface formed by the bit body.

An alternative embodiment is shown in FIGS. 4 and 5 wherein the mating interfaces 226 and 232 formed between bit body 212 and the nozzle receptacle generally designated as 230 are radiused such that the nozzle receptacle may be moved along the interface radially outwardly or inwardly to align an axis of a jet nozzle as desired as shown in the alternative phantom position. The opening 235 to passage 234 is necessarily smaller than opening 215 to plenum 213 to enable the nozzle receptacle to be rotated along the interfaces 226 and 232 and still be in unobstructed alignment with the plenum opening 215. The outer surface 236 of the body 231 should be contoured to clear a borehole side wall when the nozzle receptacle is rotated outwardly (not shown). Threaded opening 238 receives a jet nozzle and exit end 239 may be of any length within the design limits of the rock bit.

FIG. 5 clearly depicts the radiused convex planar interface surface 232 that mates with minor concave interface surface 226 formed in bit body 212 of bit 210. Opening 235 is of generous size to allow an uninterrupted fluid flow from plenum 213 into passage 234 that is formed in the nozzle receptacle module 230. Again, a lengthy and generous weld 228 circumventing the module 230 assures a robust nozzle receptacle that is far superior to the extended nozzle shown in the prior art of FIG. 2.

Figure 6:
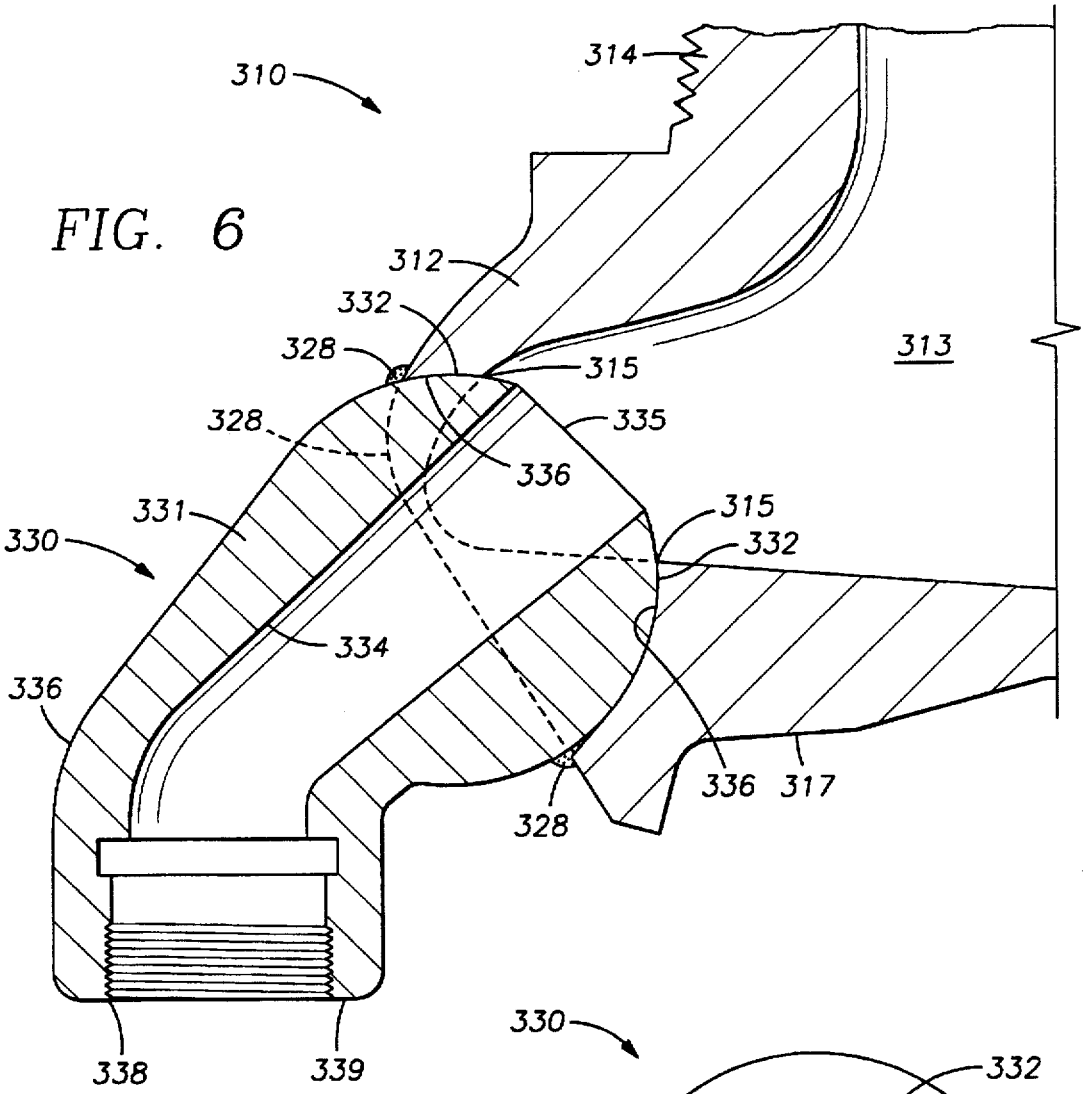
FIG. 6 is a partial cross-section of yet another alternative embodiment of the present invention wherein a nozzle receptacle is mated to a ball socket, the mating portion of the receptacle being a sphere designed to nestle within a ball socket interface formed by the bit body thereby providing infinite nozzle vectoring potential limited only by the bit parameters and surrounding borehole.
Figure 7:
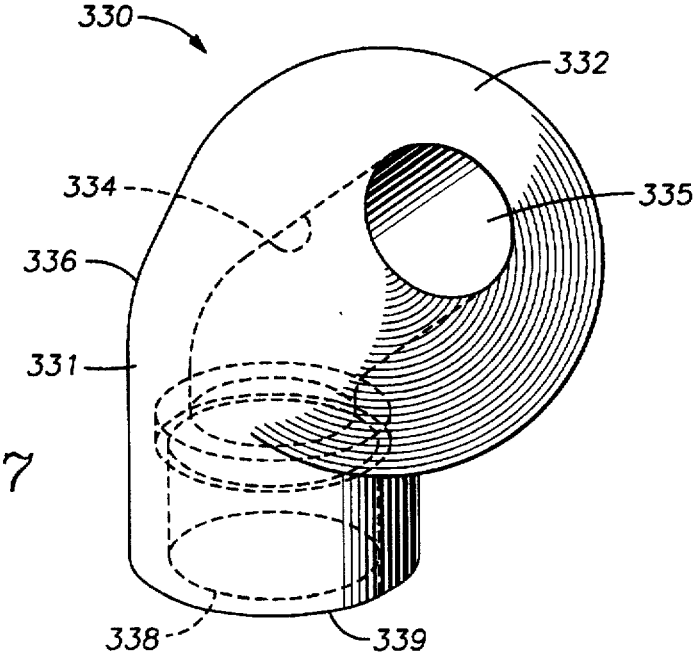
FIG. 7 is a perspective view of the nozzle receptacle of FIG. 6.

Yet another embodiment of the present invention is illustrated with respect to FIGS. 6 and 7. A nozzle receptacle generally designated as 330 utilizes a spherical ball and socket combination wherein the ball portion defining spherical surface 332 formed by body 331 seats within a mirror ball socket surface 336 formed by body 312 of bit 310. Opening 335 formed in surface 332 leads into passage 334 formed by body 331. Fluid from plenum 313 is directed through enlarged opening 315 into the passage 334 in an uninterrupted flow since the concave portion of the receptacle protrudes into the plenum 313.

The ball socket connection formed by the nozzle receptacle module 330 enables the nozzle flow exiting a jet nozzle installed in opening 338 in exit end 339 of module body 331 to be vectored or directed in any number of ways limited only by the design constraints of the rotary cone bit the nozzle is installed in.

The ball or spherical portion of the nozzle receptacle is welded around the circumference of the ball at weld 328 thereby providing a very strong support for the receptacle 330.

The perspective view of FIG. 7 clearly depicts the spherical surface 332 of the nozzle receptacle 330. Opening 335 directs fluid into passage 334 toward exit end 339 of body 331. The jet nozzle is retained within threaded end 338 (not shown).

Another embodiment is illustrated in FIGS. 8 and 9 wherein a plenum end 435 formed by receptacle body 431 protrudes into plenum 13 formed by bit body 12. End 435 forming the entrance to streamlined passage 434 is rounded to provide a reduced turbulent entrance of fluid to passage 434. The opening 426 formed in the bit body 12 may be formed in various types and sizes of bit body plenums since the receptacle plenum end 435 is designed to protrude far enough into the bit plenum to allow for various bit body diameters and shapes. Hence, a nozzle receptacle generally designated as 430 is adaptable to many bit bodies provided the opening 426 in the differing bits match joining surfaces 432 formed by receptacle 430.

As heretofore mentioned, nozzle retainers or receptacles with matching connecting interfaces may be welded in the field or welded after manufacture of the bit at the manufacturing facility prior to shipment from off the shelf bits as opposed to the in-manufacturing process whereby same sized bits are interfitted with different nozzle configurations that can only be accomplished while the bit is manufactured thus resulting in larger than necessary inventories to accommodate field requirements.

It will of course be realized that various modifications can be made in the design and operation of the present invention without departing from the spirit thereof. Thus while the principal preferred construction and mode of operation of the invention have been explained in what is now considered to represent its best embodiments which have been illustrated and described, it should be understood that within the scope of the appended claims the invention may be practiced otherwise than as specifically illustrated and described.

What is claimed is:

1. A rock bit body rotating about an axis having an interior plenum for allowing fluid to pass therethrough further comprising;

a nozzle retention body having an upper end for attachment to the rock bit body and a lower end for retaining a nozzle, the nozzle retention body having an interior channel passing therethrough, the upper end, when attached to the rock bit body, forming a portion of the interior plenum, the rock bit body further including an interface surface and the nozzle retention body further including an interface surface which mates with the interface surface of the rock bit body, the upper end of the nozzle retention body forming an interface surface that is a convex radial curved surface that encompasses a fluid entrance port forming part of the interior channel, the rock bit body further forming a complimentary concave radial curved interface surface, the convex radial curved surface at the upper end of the nozzle retention body protruding into the plenum formed by the rock bit body, the radial curved interface surfaces enable the nozzle retention body to be angled radially with respect to the axis of the rock bit.

2. The invention as set forth in claim 1 wherein the interface formed by the nozzle retention body forms two sides that mirror complimentary interface surfaces formed by the rock bit body.

3. The invention as set forth in claim 1 wherein the upper end of the nozzle retention body forms an interface surface that is a portion of a spherical ball, the spherical ball interface surface encompasses a fluid entrance port forming a part of the interior channel, the spherical ball interface surface conforms to a complimentary spherical socket interface surface formed by the rock bit body; the ball and socket interface surfaces enables the nozzle retention body to be angled with respect to an axis of the rock bit in any direction confined only by the design constraints of the rock bit.

4. The invention as set forth in claim 3 wherein the portion of the spherical ball formed by the nozzle retention body protrudes into the plenum formed by the rock bit body.

5. The invention as set forth in claim 1 wherein the upper end of the nozzle retention body protrudes into the plenum formed in the body of the rock bit.

6. The invention as set forth in claim 1 wherein the nozzle retention body is metalurgically bonded to the rock bit.

7. The invention as set forth in claim 6 wherein the metallurgical bond is a weld.

8. A rock bit body having an interior plenum for allowing fluid to pass therethrough further comprising;

a nozzle retention body having an upper end for attachment to the rock bit body and a lower end for retaining a nozzle, the nozzle retention body having an interior channel passing therethrough, the upper end, when attached to the rock bit body, forms a portion of the interior plenum, an exterior radially disposed upper surface formed by the nozzle retention body having a multiplicity of hardened cutters strategically positioned on the upper surface, the hardened cutters serve as backreamers to clear debri from the rock bit when the bit is removed from a borehole.

9. The invention as set forth in claim 8 wherein an axially disposed outer surface formed by the nozzle retention body nearest the lower end of the body has a multiplicity of hardened cutters strategically positioned on the axially disposed surface, the hardened cutters serve to protect the nozzle retention body from contact with a wall forming the borehole.

10. The invention as set forth in claim 9 wherein the hardened cutters are tungsten carbide inserts retained in insert sockets formed in the radially and axially exterior surfaces formed by the nozzle retention body.

11. The invention as set forth in claim 9 wherein the hardened cutters are polycrystalline diamond inserts.

* * * * *